US005837921A

United States Patent [19]

Rinaldi et al.

[11] Patent Number: 5,837,921

[45] Date of Patent: Nov. 17, 1998

[54] GUN BARREL WITH INTEGRAL MIDWALL COOLING

[75] Inventors: Christopher S. Rinaldi, Arlington, Va.; Jeffrey W. Haas, Troy, N.Y.; Edward J. Hyland, Clifton Park, N.Y.; James A. Neese, Albany, N.Y.

[73] Assignee: The United States of America as represented by the Secretary of the Army, Washington, D.C.

[21] Appl. No.: 819,409

[22] Filed: Mar. 17, 1997

Related U.S. Application Data

[63] Continuation-in-part of Ser. No. 761,155, Dec. 6, 1996, abandoned, which is a continuation of Ser. No. 441,551, May 18, 1995, abandoned, which is a continuation of Ser. No. 332,861, Oct. 11, 1994, abandoned.

[51] Int. Cl.[6] ..... F41A 13/12; F41A 21/24

[52] U.S. Cl. ..... 89/14.1; 89/16; 29/1.11

[58] Field of Search ..... 89/14.1, 16; 29/1.11

[56] References Cited

U.S. PATENT DOCUMENTS

| | | | |
|---|---|---|---|
| 335,606 | 2/1886 | Mefford | 89/14.1 |
| 400,160 | 3/1889 | Babbitt | 89/14.1 |
| 1,514,167 | 11/1924 | Morgan et al. | 29/1.11 |
| 3,228,298 | 1/1966 | Grandy et al. | 89/16 |
| 3,751,954 | 8/1973 | Ezra et al. | 72/56 |
| 4,911,060 | 3/1990 | Greenspan et al. | 89/14.05 |
| 4,982,648 | 1/1991 | Bol et al. | 89/14.1 |
| 5,160,802 | 11/1992 | Moscrip | 89/16 |
| 5,177,990 | 1/1993 | Isgen | 72/54 |

FOREIGN PATENT DOCUMENTS

| | | |
|---|---|---|
| 615582 | 1/1927 | France . |
| 603976 | 6/1948 | United Kingdom . |

*Primary Examiner*—Michael J. Carone
*Assistant Examiner*—Christopher K. Montgomery
*Attorney, Agent, or Firm*—Michael C. Sachs

[57] ABSTRACT

A composite gun barrel 10 with active cooling having a breech end and a discharge end. The barrel includes an outer jacket 11 having radially inwardly projecting ports 15 proximate the breech end 25 extending inwardly from the outer diameter of the jacket, and an inner liner 13 inside the jacket and extending beyond the discharge end of the jacket prestressed by autofrettage to form a permanent integral assembly. The inner liner has a circumferentially located annular space 17, the ports being in operable communication with the annular space. A plurality of circumferentially spaced longitudinal channels 19 on the liner extend from the annular space to a location 21 beyond the discharge end of the jacket. The liner includes a shoulder 23 located between the breech end of the barrel and the inwardly projecting ports for locating the jacket on the liner. The liner includes an outer terminal liner portion 27 on the breech end extending beyond the jacket to permit the liner to be held in position for insertion into the jacket, the outer terminal liner portion being removable to form a desired barrel length during finishing of the barrel. Similarly, the jacket includes an outer terminal jacket portion 29 on the breech end extending partially between the outer terminal liner portion and the desired barrel length, the outer terminal barrel portion also being removable to form the desired barrel length during finishing of the barrel.

27 Claims, 7 Drawing Sheets

GUN BARREL WITH INTEGRAL MIDWALL COOLING

This application is a continuation-in-part of application Ser. No. 08/761,155 filed Dec. 6, 1996, which is a continuation or application Ser. No. 08/441,551 filed May 18, 1995, which is in turn a continuation of application Ser. No. 08/322,861 filed Oct. 11, 1994, all of which are now abandoned.

The invention described herein may be made, used or licensed by or for the U.S. Government for Governmental purposes.

BACKGROUND AND FIELD OF THE INVENTION

The present invention relates to an improved gun barrel. More particularly the present invention relates to an actively-cooled large caliber gun barrel which continually maintains chamber temperatures to less than ammunition propellant cook-off levels. This enables continuous firing of ammunition in the gun barrel, in combat, e.g., without necessity of down time as at present to allow a gun barrel to cool to below the cook-off limits. This is a great advantage over known prior art guns as can readily be seen by the ability to have non-stop firing, such not previously having been the case. In addition, the present invention relates to a gun barrel design that is admirably suited for (but not limited only to) large caliber guns that have particular strength and fatigue life requirements.

Recently the emphasis on high firing rates, particularly as extended battlefield scenarios are contemplated, has increased the need for managing the very large amount of heat generated in the bore of artillery weapons during firing. Three major problems which have been documented as being part of this modern scenario are "cook-off" of the ammunition propellant, projectile exudation, and increased tube wear. Currently, the gun barrel temperature is monitored during firing, such as in combat or training. When the barrel is judged to be too hot, the firing has to be ceased allowing the barrel to gradually cool down. This invention seeks a continuous cooling of the barrel, so that firing can continue uninterrupted. This is a great advantage as can be seen, such as during combat.

For small and medium caliber guns, such as those of 90-mm or less, thermal management has been approached by circulating a coolant through passages created between a removable tube liner and an outer jacket. This method of construction had the added advantage of allowing the liner to be replaced when worn. As long as the caliber of the gun is not too large, usually no more than the above mentioned 90-mm caliber, this had been considered an effective approach because the stress generated during firing is relatively low, so such removable liners are acceptable. Perhaps an example of such smaller caliber barrels in previous times, would be the 1948 British Patent Specification number 603,976 to Bofors Corporation, entitled "Improvement in Arrangements for Cooling Gun Barrels", which is incorporated by reference herein.

However, in large caliber guns, there are additional factors that need to be considered, such as the higher pressures (60,000 psi,). The construction of such barrels to accommodate the higher pressures is quite different and more complex than the smaller caliber (lower pressure) type barrels. The ability to simply include cooling features in such newly designed higher pressure larger caliber barrels is not straightforward, as will be described hereunder. The conventional wisdom was that providing cooling channels for higher pressure larger caliber barrels was impractical, and that such would weaken the barrel. The Applicants herein have, however, succeeded in providing design and fabrication methods for such large caliber high pressure barrels, with cooling now made possible. The higher pressures in the larger caliber barrels made removable liners (such as Bofors number 603,976) unacceptable because greater strength is required which is not attainable with current removable liners (which also are unsuitable to be autofrettaged and since also they cannot be removed after the autofrettage). It has become absolutely necessary with modern large caliber guns to have greater strength and longer fatigue life. This greater strength is approached by shrink fitting a jacket to a barrel liner for greater barrel strength, or else by prestressing the bore through autofrettage. The autofrettage structurally makes a removable liner impractical and thus not within the scope of the large caliber design parameters. Over the past hundred years or so it had also been a practice in the manufacture of large caliber guns to pre-load the inner region of the gun near the bore by shrinking layers of jackets. Prestressing the tube in this manner has the effect of offsetting the large tensile loads generated at the bore during firing. Without this prestressing, such as in large caliber modern guns, failure (such as bursting or unacceptably low life fatigue failures) would be common. Cooling such layered barrels is not considered straightforward either, because of the construction features thereof. In a previous U.S. Army by Greenspan, et al., U.S. Pat. No. 4,911,060, entitled "Reduced Weight Gun Tube", Mar. 27, 1990, (which is incorporated herein by reference) features of both shrink fitting and autofrettage are both employed to strengthen the barrel against piercing, bursting and such failures. However, no cooling was contemplated in Greenspan, et al. The Greenspan, et al. development was done instead for purposes of lightening the barrel where weight was the chief concern. It has a relatively thin jacket made of lightweight titanium, over a thicker steel liner. In this invention, by contrast, Applicants have utilized a steel on steel type barrel, with equal thickness steel jacket and liner, and in an environment where overheating, not weight, is the chief concern.

According to common belief, the proposition of adding passages in a large caliber barrel such as the 155 mm (for cooling purposes) had been considered impractical. It was considered that such cutting of any passages would weaken the barrel structurally, then the barrel could catastrophically burst, crack or deform upon usage. However, contrary to common wisdom we have discovered both through concept and also actual experimentation, that channels may indeed be provided in the barrel liner of a composite barrel in a large caliber gun if accomplished before autofrettage. Not only does the barrel not burst, etc., in use with such channels present, but additionally we have discovered that the barrel is actually strengthened, not weakened, at the site of the added channels. Now the way was clear for creating a continually-cooled large caliber gun barrel, which could now permit continuous uninterrupted firing where the possibility of ammunition propellant cook-off virtually was eliminated. There is no need now to interrupt firing, such as during combat, to cool the barrel below ammunition propellant cook-off temperatures. The chamber is continuously kept below about 350° F. (175° C.), which is cook-off temperature for certain large caliber ammunition propellant. This barrel is a great breakthrough therefore.

The placement of cooling channels should be made, as was done for our invention, on the outside of the liner, and not on the inside of the jacket. Reasons for doing so include the following: One, in the unfortunate event of a rupture of the gun, the jacket would serve to contain the burst of the liner (the weaker part would be in the liner). However, were the cooling channels in the jacket instead, which would serve to weaken the jacket, then in the event of a rupture the jacket would more easily give way. Thus the whole barrel more likely would catastrophically burst. In addition, cooling is more efficient when the cooling channels are on the liner, since they are closer to the bore where the combustion takes place.

In this invention, the liner channels for cooling are made to be present before assembly and autofrettage. Indeed, the autofrettage provides beneficial results in respect to the channels in that the channels are mechanically strengthened, as was discovered. The autofrettage was found to prestress the channels (as well as the liner), and other elements.

It is therefore an object of the present invention to provide an improved design, suitable for both large and small caliber guns which addresses the heat management issues through active cooling, as well as keeping the stresses generated during firing within allowable limits.

It is another object of the present invention to at a minimum, maintain the fatigue and wear life of large caliber guns, while still having channels placed in the liner for cooling purposes.

Other Objects will appear hereinafter.

SUMMARY OF THE INVENTION

The invention comprises a gun barrel that is capable of increased sustained firing rates without exceeding thermal limits of the cannon or cook-off temperatures, or compromising strength or fatigue life. The barrel includes an outer jacket having radially inwardly projecting ports near the breech end projecting inwardly towards an inner liner.

The inner liner has a circumferentially located annular space communicating with the ports. A plurality of circumferentially spaced longitudinal channels extend from the annual space of the liner to a location beyond the discharge end of the jacket. The liner and jacket include a shoulder located between the breech end of the barrel and the inwardly projecting ports for locating the jacket on the liner.

In a preferred embodiment, the liner includes an outer terminal liner portion on the breech end extending beyond the jacket to permit the liner to be held in position for insertion into the jacket. The jacket is then shrunk fit onto the liner. Since the liner's outside diameter is greater (by about 0.005 of an inch, e.g. about 0.127 mm) than the inside diameter of the jacket, the jacket must be separately heated from the liner until the jacket inside diameter will expand to permit insertion of the liner. This outer terminal liner portion is removed to form a desired barrel length during finishing of the barrel. Similarly, the jacket includes an outer terminal jacket portion on the breech end extending partially between the outer terminal liner portion and the desired barrel length so that when the outer portions are removed a true alignment of the barrel is achieved. The resulting assembly is then autofrettaged to the desired prestress condition, creating a permanent integral structure capable of significantly improved utility as a gun barrel.

BRIEF DESCRIPTION OF THE DRAWINGS

For a more complete understanding of the invention, reference is hereby made to the drawings.

DETAILED DESCRIPTION OF THE INVENTION

The gun barrel is meant to be a unitary item though made essentially from two parts. The outer tube is called the jacket (11), while the inner tube (13) (with pre-machined coolant channels), is called the liner. (See FIGS. 1 and 2). For smaller caliber barrels, for instance smaller than 90-mm, the two items are usually bolted together. When the liner is essentially worn out (from hundreds of firings), a new one can be replaced within the jacket and bolted in (the old liner may be discarded). The composite barrel made of the jacket plus removable liner is strong enough for lower caliber sizes mentioned above. However, with larger calibers such as 155-mm, the conventional removable liner construction will not withstand the stresses generated during firing and the fatigue life of the cannon will be severely reduced. The gun barrel of this invention is made of liner (having pre-machined coolant channels thereon), and jacket, but they are joined by shrink fitting (to be explained), then also autofrettaged (to be explained), to prestress the liner. This results in a superior strength gun barrel that can withstand the extreme internal pressures of firing. First, the jacket, which has an inside diameter slightly smaller than the outside diameter of the liner, is heated while the liner is not heated. The liner is inserted into the hot jacket. As the jacket cools, it grabs the liner very tightly. Next, an oversized mandrel is mechanically rammed down the length of the barrel. This is called autofrettage.

One purpose of the autofrettage is to further join the liner and jacket making for an even more permanent integral structure. The high contact forces induced between the liner and jacket during autofrettage are such that relative motion between the liner and jacket is not thereafter possible. This eliminates the need for any fastening devices such as screws, retaining nuts, torque keys or pins. Another effect of autofrettage is to prestress the gun barrel to enhance its strength and increase its fatigue life. During autofrettage the metal is stressed beyond its elastic limit. This causes the barrel to have favorable residual compressive stresses built into it. A uniqueness of the present invention includes the presence of cooling channels and the radially projecting ports within the gun barrel before, and thus also during the autofrettage process. We have discovered that, in this invention, autofrettage not only imparts circumferentially oriented residual compressive stresses, but in addition, favorable compressive residual stresses are imparted at the root of the cooling channels and around the radially projecting ports, the result of which is lower stresses in the cooling channel and port areas leading to an overall enhanced strength and enhanced fatigue life of the gun barrel.

Figure 2:
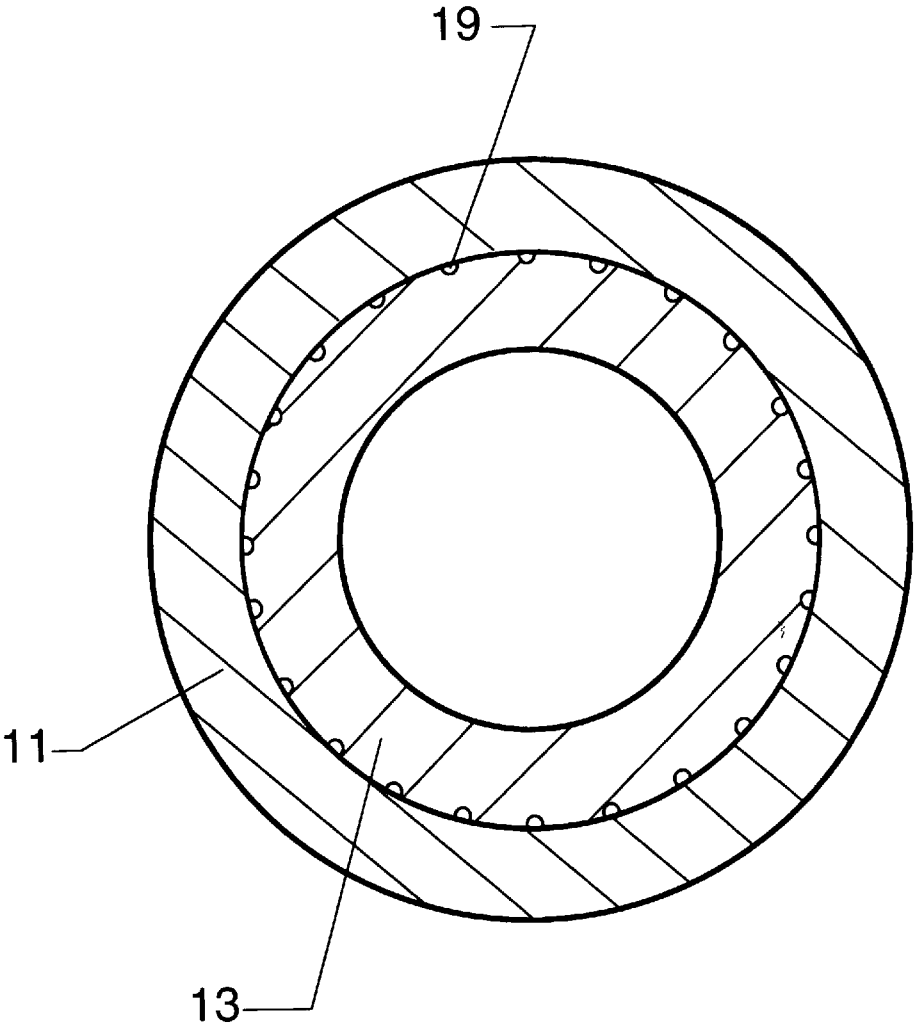
FIG. 2 is a view taken along the line A—A shown in FIG. 1.

The following further discusses the midwall cooling. The outside surface of the liner, as previously discussed, is provided with straight parallel channels having semicircular cross-section of perhaps 12.7 mm (½") diameter (actually open semicircles) as shown in FIG. 2, in one example. The thickness of the liner (and also of the jacket) might be 38 mm (1½"), for example, while the bore diameter is 155 mm. These straight parallel channels are shown as equally spaced around the outer circumference of the liner and each is parallel to the long axis of the gun barrel. The channels therefore are present before the liner is inserted into the jacket and shrink joined. There are ports (15) already in the outer jacket also before the jacket is shrink fitted. It can be seen now that it is possible to pump coolant into ports 15 and have it flow into and through the annual space 17, and then out of a channel or channels to the front end of the barrel (and out at 21) for instance. Recirculation is also possible and desirable. The liquid can be recovered and then recirculated. A good mix for the coolant can be ethylene glycol and water. This is both anti-corrosive and is an anti-freeze. The recirculation process can include pumps, transfer lines and a radiator to dissipate surplus heat. There is a ridge left machined on the inner liner that is the shoulder 23 which aids in locating the positioning of the outer jacket over the liner before the jacket is allowed to cool during manufacture. Also possible may be an elliptical-shaped cross-section for the channels (actually, semi-elliptical) rather than the circular shape (actually, semi-circular). The channels could be the depth of, 6.35 mm (¼") for example, but would be wider than comparable circular ones would be. This would preserve more of the barrel's strength distributing the stresses around the channels.

What has been shown therefore is a unitary large caliber gun-barrel having active cooling and which is prestressed for great strength by a shrink-fitted outer jacket, and an autofrettaged inner liner, which composite barrel is then capable of sustained firing rates without exceeding thermal limits or compromising strength, in a way not possible with known conventional cannons.

Figure 3:
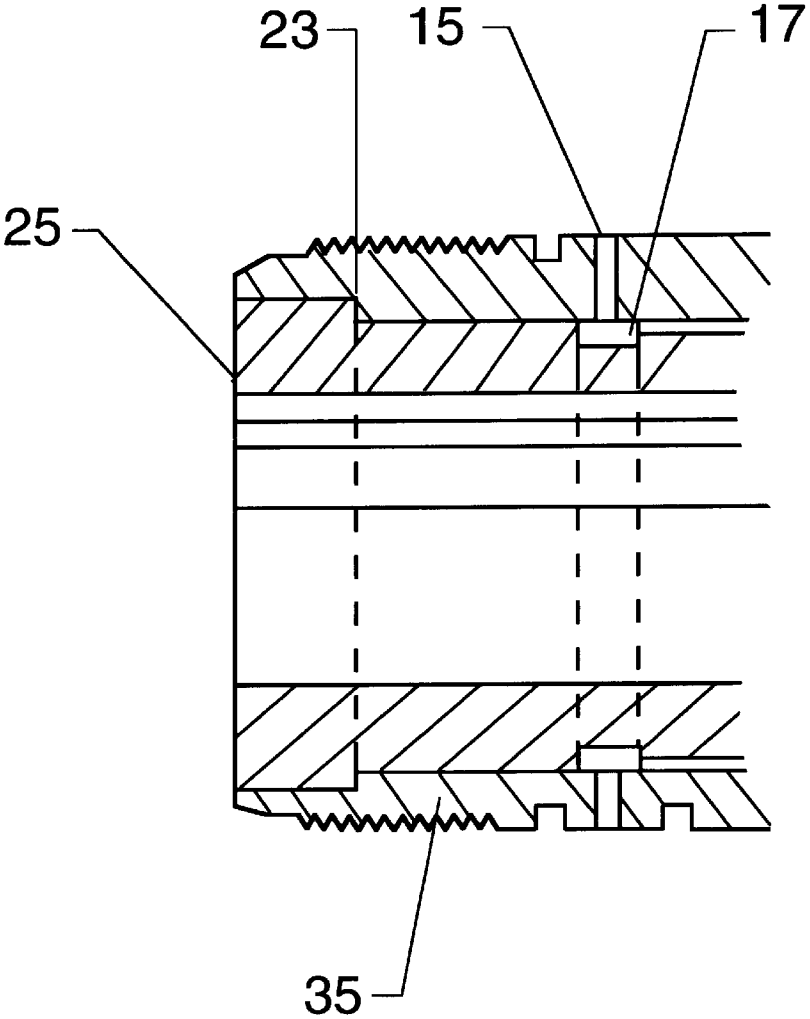
FIG. 3 is an enlarged view of the left or breech end of the device shown in FIG. 1.
Figure 4:
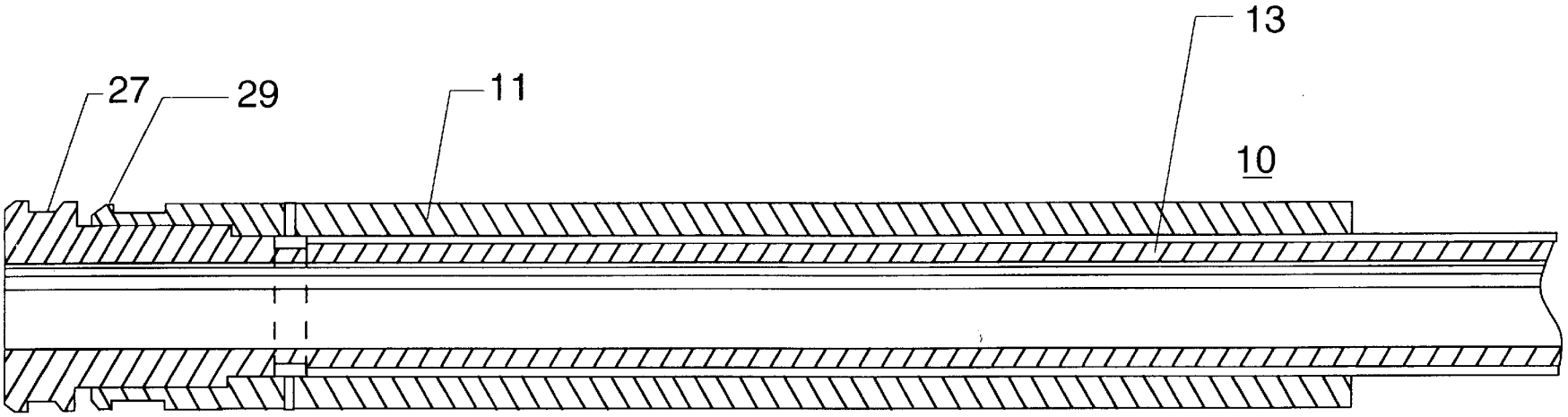
FIG. 4 is a side elevational view, in section, of the barrel as shown in FIG. 1 at the point of shrink assembly.

FIG. 3 shows the location of shoulder 23 as being between the breech end 25 of the barrel and ports 15. Shoulder 23 assists in locating jacket 11 and liner 13 in proper alignment for assembly. As shown in FIG. 4, liner 13 has been inserted into jacket 11 for assembly. The jacket 11 is shrunk onto the liner 13 as liner 13 is held by an appropriate tool at an outer terminal liner portion 27. Outer terminal liner portion 27 extends beyond jacket 11 on liner 13 to permit liner 13 to be held in position as it is inserted into jacket 11. Also provided to assist in the assembly of the barrel is an outer terminal jacket portion 29. Jacket portion 29 is used to hold jacket 11 during the shrink assembly process.

Figure 5:
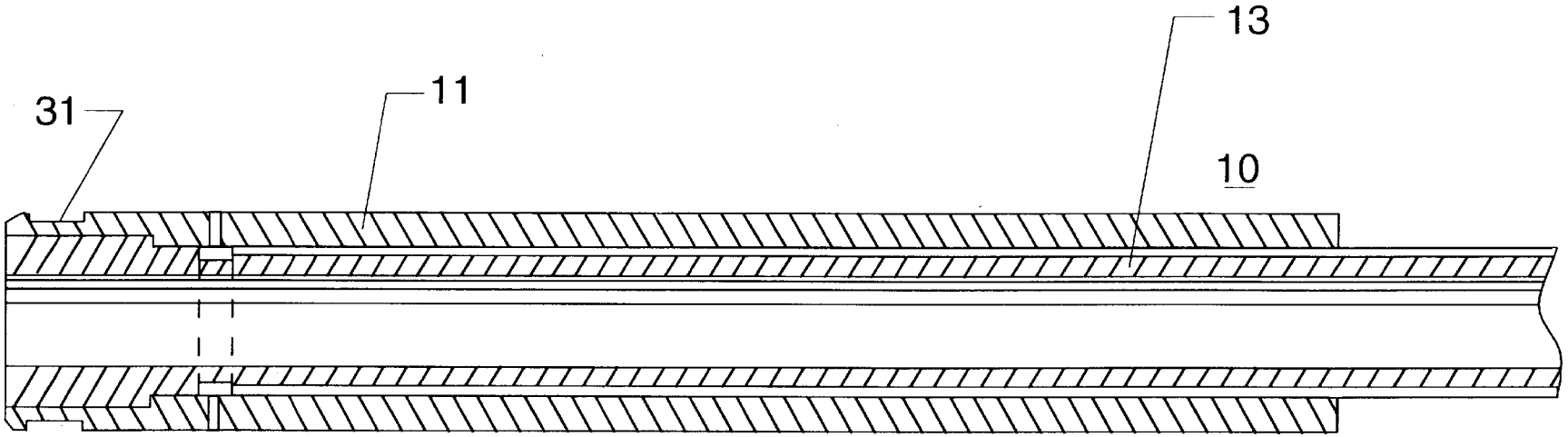
FIG. 5 is a side elevational view, in section, of the barrel shown in FIG. 1 at the point of swage assembly.

FIG. 5 illustrates an intermediate step wherein part of liner 27 is cut from the assembly, after the shrink fit step and prior to autofrettage. Jacket portion 29 is used to hold jacket 11 and liner 13 during the autofrettage process. The autofrettage process induces residual stresses into the barrel to achieve the proper strength requirements while also creating sufficiently high contact forces between jacket 11 and liner 13 to create a permanent and integral assembly. The barrel can now undergo final machining as desired.

Figure 6B:
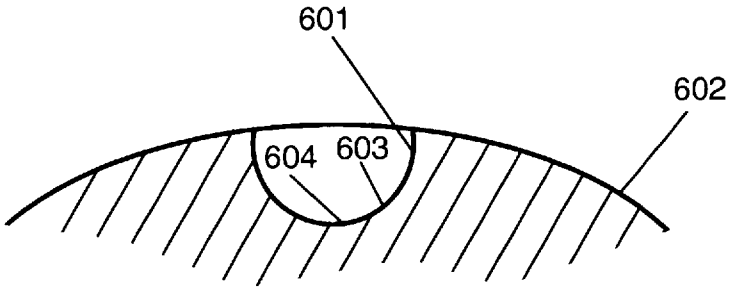
FIGS. 6A and 6B show the effect of the autofrettage upon the channels.
Figure 6A:
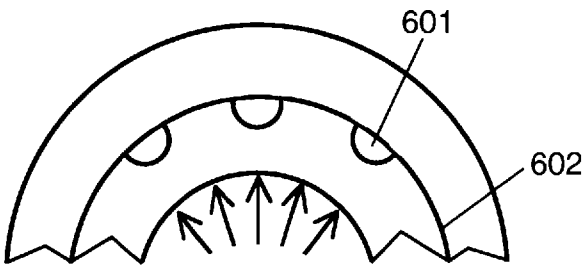
Figure 7B:
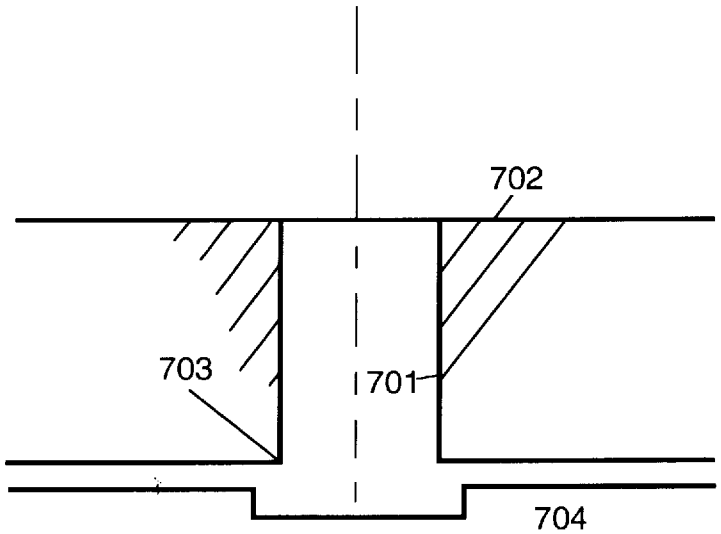
FIGS. 7A and 7B show the effect of the autofrettage upon the ports.
Figure 7A:
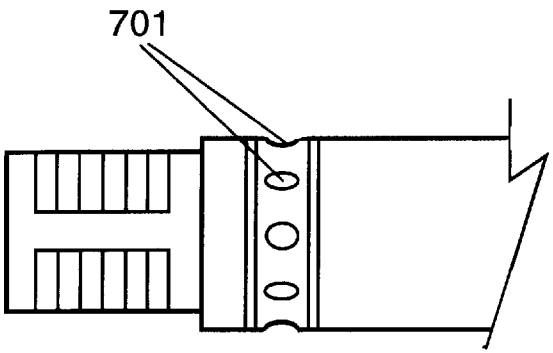

FIG. 6A and 6B show the cross-section of one of the semicircular cooling channels 601 in the liner 602 as shown in FIG. 6B, as a result of the autofrettage process, the metal in region 603, e.g., and at the base region 604 are placed into a state of compressive residual stress. The compressive residual stress greatly enhances the overall load bearing strength of the region by counteracting the tensile stress generated during the firing of the gun. Ordinarily the presence of a stress concentration, such as the cooling channel, would be expected to weaken the overall structure of the liner and barrel to such a degree that it would have little utility as a large caliber gun barrel. In this invention however, it has been found that by placing the cooling channels in the barrel liner prior to autofrettage, and then using the autofrettage process to prestress the cooling channels, that to the contrary, a significant enhancement in the strength of the cooling channels is achieved. Similarly, a beneficial strengthening by prestressing (brought on by autofrettage) is attained in the coolant inlet ports. FIGS. 7A and 7B show views of the coolant inlet ports. FIG. 7B shows a port 701, formed through a jacket 702. Region 703, e.g., is strengthened (and so are the ports, to be described herebelow). A beneficial strengthening by prestress has been brought on by the autofrettage at region 703. (Region 703 encircles and strengthens the port). FIG. 7A shows an outside sketch of the breech end of the cannon, which helps to illustrate the position of such inlet ports. In FIG. 7B the jacket 702 overlays liner 704 (actually liner 13 in FIG. 1) and the port 701 is made to lie over the annular space 17 (shown in FIG. 3).

Figure 1:
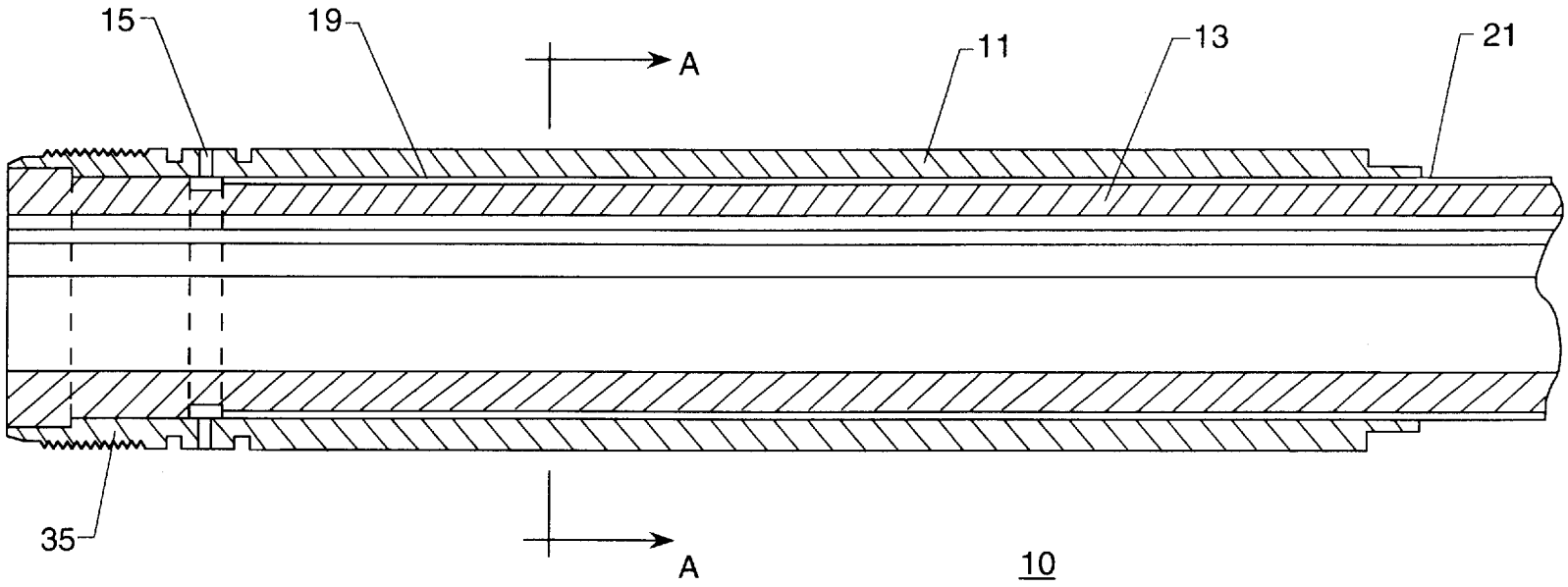
FIG. 1 is a side elevational view, in section, of a finished barrel according to this invention.

Also shown in FIG. 1 is a torque key 35 for mounting the assembly in a gun. The completed assembly shown in FIG. 1, shown generally by 10, is in finished condition for mounting in a gun.

One of the major concerns during the completion of the present invention was the potential for an adverse effect on fatigue life by weakening the overall strength of the gun by the provision of cooling channels and cooling features within the structure of the barrel. This it is believed has now been overcome. To demonstrate the efficacy of the present invention, a series of live firings as well as laboratory pressure tests of a completed gun were made using the barrel of the invention. To date, over 1,000 maximum pressure rounds have been fired and over 10,000 laboratory pressure test cycles have been completed on two separate test cannons. Fatigue life has been determined to be in excess of 3,500 rounds.

While particular embodiments of the present invention have been illustrated and described herein, it is not intended that these illustrations and descriptions limit the invention. Changes and modifications may be made herein without departing from the scope of the following claims.

We claim:

1. A composite gun barrel having a breech end and a discharge end, comprising:

an outer jacket having radially inwardly projecting ports proximate said breech extending inwardly from the outer diameter of said jacket, an inner liner inside said jacket and extending beyond the discharge end of said jacket, said inner liner having a circumferentially located annular space, said ports being in operable communication with said annular space, and a plurality of circumferentially spaced longitudinal channels on the outside diameter of said liner and extending from said annular space to a location beyond said discharge end of said jacket, said liner being positioned inside said jacket, and said liner including a shoulder located between said breech end of said barrel and said inwardly projecting ports for locating said jacket on said liner, said jacket further being shrunk around said liner, such jacket and liner then being autofrettaged to form an integral barrel structure.

2. The barrel of claim 1, wherein both jacket and liner are of steel and of equal thickness.

3. The barrel of claim 2 wherein said gun barrel is liquid cooled, through said channels.

4. The barrel of claim 3, wherein said ports are essentially evenly spaced circumferentially around said jacket, and said channels are essentially evenly spaced circumferentially around said outside diameter of said liner.

5. The barrel of claim 4 wherein said barrel is a 155 mm cannon.

6. The barrel of claim 3, wherein said liner includes an outer terminal liner portion on said breech end extending beyond said jacket to permit said liner to be held in position for insertion into said jacket, said outer terminal liner portion being removable to form a desired barrel length during finishing said barrel.

7. The barrel of claim 6, wherein said jacket includes an outer terminal jacket portion at said breech end extending partially between said outer terminal liner portion and said desired barrel length, said outer terminal barrel portion also being removable to form said desired barrel length during finishing of said barrel.

8. The barrel of claim 3, wherein said cannon and liner are prestressed as a result of said autofrettage.

9. The barrel of claim 8, wherein said channels are mechanically strengthened as a result of said autofrettage.

10. The barrel of claim 9, wherein favorable residual compressive stresses are created in the area around the ports as a result of said autofrettage.

11. The barrel of claim 10, wherein favorable residual compressive stresses are created in the root of said circumferentially oriented longitudinal channels as a result of said autofrettage.

12. The barrel of claim 2 wherein said barrel may be continually cooled with liquid through said channels to prevent interior gun temperatures from exceeding ammunition propellant cook-off levels, this enabling continuous firing of ammunition without interruption due to occurrence of cook-off.

13. The barrel of claim 4 wherein said barrel experiences firing pressures of at least 60,000 pounds per square inch.

14. The barrel of claim 1, wherein the liner requires no fastening means to be retained as an integral part of said barrel.

15. Method for fabricating and providing cooling channels for a 155 mm composite cannon barrel in a firing environment expected to exceed 60,000 psi of pressure, comprising the steps of:

(i) cutting longitudinal channels in the exterior of a cylindrical steel liner tube, said channels equally parallel spaced around the circumference of said liner tube;

(ii) providing a second cylindrical steel jacket tube of equal thickness but having inside diameter of said liner tube less than the outside diameter of said liner tube, by an amount up to 0.005 inches;

(iii) independently heating said jacket tube to expand the said inside diameter sufficient to accommodate insertion of the liner tube;

(iv) inserting the liner tube within the jacket tube and allowing such combination to cool together to form as one common, cannon assembly; and (v) autofrettaging said cannon assembly by mechanically ramming an oversized mandrel down the length of the cannon assembly bore.

16. The method of claim 15 wherein there is an additional process in step (ii) of drilling inlet holes into said jacket tube, which holes are equally spaced around the circumference of the jacket tube and located near one end of the jacket tube.

17. The method of claim 16 wherein there is an additional process in step (i) of cutting, near one end of the liner tube, an annular channel to form a recessed ring about the liner tube circumference which ring also intersects all of said longitudinal channels.

18. The method of claim 17 wherein there is an additional process in step (iv) of upon insertion of the liner tube, to line up the said holes of said jacket to the said annular channel ring before cooling.

19. A gun barrel comprising in combination:

a cylindrically shaped jacket including a breech end, a discharge end, and a plurality of radial ports, said plurality of radial ports being disposed proximate to said breech end;

a hollow, cylindrically shaped liner fitting tightly within said jacket and extending beyond said jacket discharge end;

said liner including a circumferential annular space in communication with said radial ports;

a plurality of circumferentially spaced, longitudinal channels formed on an outer periphery of said liner, and extending underneath said jacket from said annual space of said liner toward said jacket discharge end;

said channels being in communication with said annular space and said plurality of radial ports, for allowing a cooling fluid to flow therethrough; and said channels being stressed subsequent to assembling said jacket and said liner, for significantly enhancing the strength and fatigue life of said liner and ultimately the gun barrel.

20. The gun barrel of claim 19, wherein said channels have a generally semi-circular cross-section.

21. The gun barrel of claim 19, wherein said channels have a generally elliptical cross-section.

22. The gun barrel of claim 19, wherein said channels extend from said annular space of said liner to a location beyond said jacket discharge end.

23. The gun barrel of claim 19, wherein said channels are stressed by an autofrettage process.

24. The gun barrel of claim 19, wherein a favorable compressive residual stress is imparted around said radial ports subsequent to assembling said jacket and said liner, for significantly enhancing the strength and fatigue life of the gun barrel.

25. A method of fabricating a gun barrel comprising:

providing a cylindrically shaped jacket with a breech end, a discharge end, and a plurality of radial ports, said plurality of radial ports being disposed proximate to said breech end;

providing a hollow, cylindrically shaped liner with an internal, circumferential annular space;

forming a plurality of circumferentially spaced, longitudinal channels on an outer periphery of said liner, said channels being in communication with said annular space;

fitting said liner within said jacket, with said liner extending beyond said jacket discharge end, said channels extending underneath said jacket from said annular space of said liner toward said jacket discharge end, and said channels being in communication with said annular space and said plurality of radial ports, for allowing a cooling fluid to flow therethrough; and stressing said liner within said jacket, for significantly enhancing the strength and fatigue life of said channels and ultimately the gun barrel.

26. The method of claim 25, wherein said step of stressing said channels includes using an autofrettage process.

27. The method of claim 25, wherein said step of stressing includes imparting a favorable compressive residual stress around said radial ports, for significantly enhancing the strength and fatigue life of the gun barrel.

* * * * *